US005126012A

United States Patent [19]

Hendren et al.

[11] Patent Number: 5,126,012

[45] Date of Patent: Jun. 30, 1992

[54] HIGH STRENGTH PAPERS FROM FLOC AND FIBRIDS

[75] Inventors: Gary L. Hendren, Richmond; Hamid M. Ghorashi, Midlothian, both of Va.

[73] Assignee: E. I. Du Pont de Nemours and Company, Wilmington, Del.

[21] Appl. No.: 640,592

[22] Filed: Jan. 18, 1991

Related U.S. Application Data

[63] Continuation-in-part of Ser. No. 491,581, Mar. 12, 1990, abandoned.

[51] Int. Cl.[5] ..... D21H 13/26

[52] U.S. Cl. ..... 162/146; 162/156; 162/157.3; 428/395; 428/902; 428/903; 528/184; 528/185; 528/331

[58] Field of Search ..... 162/145, 146, 152, 156, 162/157.1, 157.3; 428/288, 90, 902, 903, 395; 528/183, 184, 185, 211, 323, 324, 329.1, 331, 367

[56] References Cited

U.S. PATENT DOCUMENTS

| | | | |
|---|---|---|---|
| 2,999,788 | 9/1961 | Morgan | 162/157.3 |
| 3,756,908 | 9/1973 | Gross | 162/157.3 |
| 4,041,116 | 8/1977 | Baud et al. | 162/157.1 |
| 4,183,782 | 1/1980 | Boadoc | 162/156 |
| 4,498,957 | 2/1985 | Sasaki et al. | 428/288 |
| 4,515,656 | 5/1985 | Memeger, Jr. | 162/101 |
| 4,519,873 | 5/1985 | Amano et al. | 162/157.3 |
| 4,864,009 | 9/1989 | Finke et al. | 528/185 |
| 4,898,896 | 2/1990 | Maj et al. | 528/323 |
| 4,931,533 | 6/1990 | Herold | 528/185 |

FOREIGN PATENT DOCUMENTS

| | | | |
|---|---|---|---|
| 0239915 | 10/1987 | European Pat. Off. | 428/395 |
| 61-97355 | 5/1986 | Japan | 428/395 |

*Primary Examiner*—W. Gary Jones
*Assistant Examiner*—Todd J. Burns

[57] ABSTRACT

A high strength fibrid-floc sheet is made of a floc which can be carbon, aramid or glass. The fibrids are made from the following units:

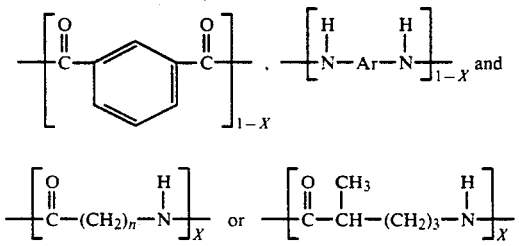

where n is 4 or 5; X is from 0.03 to 0.30 and Ar is a radical selected from 3,4'-oxydiphenylene, 4,4'-oxydiphenylene, 4,4'-sulfonyldiphenylene, 1,3-phenylene, 1-methyl-2,4-phenylene, and mixtures of such radicals with each other or mixtures of such radicals with up to 50 mol percent of 1,4-phenylene radicals based on the mixtures of radicals.

8 Claims, No Drawings

HIGH STRENGTH PAPERS FROM FLOC AND FIBRIDS

RELATED APPLICATION

This application is a continuation-in-part of our application Ser. No. 07/491,581 filed Mar. 12, 1990.

BACKGROUND OF THE INVENTION

Wet-laid nonwoven sheets of synthetic polymeric fibrids and short length staple fibers are known from U.S. Pat. No. 2,999,788. Increased bonding of these sheets can be obtained by application of heat and/or pressure. As taught in said patent, the fibrids are prepared by shear precipitation of solutions of the polymer, preferably in an aqueous medium. Generally, the fibrids are directly converted into nonwoven sheet structures or paper by paper-forming techniques similar to those employed with wood pulp. Preferably, the aqueous mix used to prepare the nonwoven sheets by paper-making methods will include short fiber or floc in addition to the fibrids. Other materials may be added as desired.

The nature of the floc and fibrids as well as the interaction between them will, of course, determine the sheet properties and the end use applications to which they may be applied. It is an object of the present invention to obtain sheet structures exhibiting high strength and a high glass transition temperature, (Tg). Some of the novel sheet products exhibit outstanding electrical properties as well.

SUMMARY OF THE INVENTION

The invention provides high strength nonwoven sheet structures consisting essentially of from 10 to 90 wt. % of floc of carbon, aramid or glass fiber held in place with from 90 to 10 wt. % of fused fibrids consisting essentially of the following units

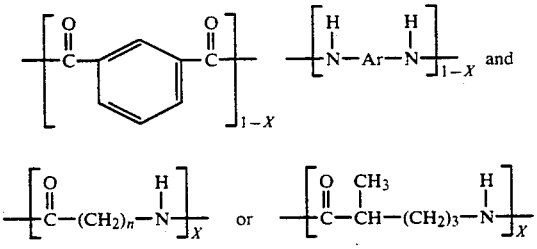

where n is 4 or 5; X is from 0.01 to 0.50, preferably from 0.03 to 0.30, and Ar is a radical selected from 3,4'-oxydiphenylene, 4,4'-oxydiphenylene, 4,4'-sulfonyldiphenylene, 1,3-phenylene, 1-methyl-2,4-phenylene, and mixtures of such radicals with each other or mixtures of such radicals with up to 50 mol percent of 1,4-phenylene radicals based on the mixture of such radicals. The novel fibrids are also part of this invention.

DETAILED DESCRIPTION OF THE INVENTION

Sheet products of the present invention are wet-laid, hot-pressed sheets of floc of carbon, aramid or glass and certain novel fibrids.

The term "floc" is used to describe short length fibers as customarily used in the preparation of wet-laid sheets. Floc suitable for use in this invention will normally have lengths less than 2.5 cm. In the examples, the floc fibers had a linear density of 2.2 dtex and a cut length of about 0.68 cm. Such floc provides maximum strength and resistance to shrinkage of resultant sheet.

Fibrids are very small, nongranular, flexible, fibrous or film-like particles. At least one of their three dimensions is of minor magnitude relative to the largest dimension. They are prepared by precipitation of a solution of polymeric material using a non-solvent under very high shear. Suitable fibrids and methods for their preparation are described in U.S. Pat. No. 2,999,788 issued Sep. 12, 1961, to P. W. Morgan. Fibrids are always prepared as dispersions in liquid. They can be converted to aqueous slurries by suitable washing techniques. Fibrids characteristically have a high absorptive capacity for water and when deposited on a screen have sufficient strength even when wet to permit processing on a paper machine.

Suitable sheets can be made by uniformly depositing an aqueous slurry of the paper-making fibrous material onto a foraminous surface (e.g., a fine-mesh screen or fabric) through which much of the water quickly drains to form an initial sheet. Sheets prepared prepared one at a time on laboratory-scale paper-forming equipment are designated "handsheets".

The fibrids employed in the present invention are prepared from a polymer having the following repeat units in the indicated proportions:

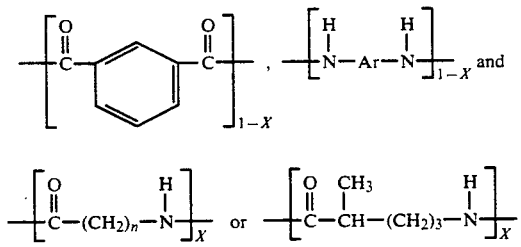

where n is 4 or 5; X is from 0.01 to 0.50; and Ar is a radical selected from 3,4'-oxydiphenylene, 1,3-phenylene, 1-methyl-2,4-phenylene, and mixtures of such radicals with each other or with up to equimolar amounts of 1,4-phenylene radicals.

The following examples except for the controls are illustrative of this invention and are not intended as limiting.

EXAMPLE 1

This example shows preparation of fibrids of this invention.

A polymer having the following repeat units was prepared in accordance with the procedures of copending and coassigned U.S. application Ser. No. 07/402,295, filed Sep. 5, 1989, now abandoned.

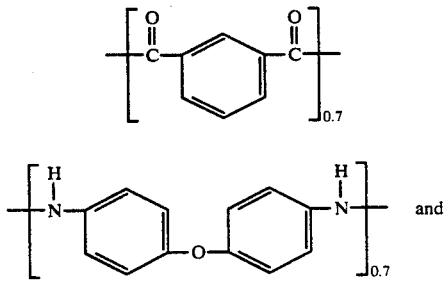

-continued

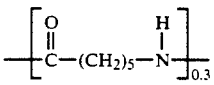

About 36 g of the polymer (inherent viscosity 0.5) was combined with 264 g of dimethylacetamide (DMAc) containing 4% LiCl to yield a 12% polymer solution. This solution was heated to 85° C. to dissolve the polymer until a clear, light brown/gold solution is obtained.

A Waring 7011 blender (model 31BL02) was filled with 50 mL of DMAc (4% LiCl) and 200 mL distilled water. With the blender run on high speed, 75 mL of polymer solution was poured slowly into top of the blender (stream ~0.3 cm wide at top of blender). The resulting fibrids were vacuum filtered onto Whatman International Ltd. #41 filter paper and washed 5 times with ~500 mL of water to remove excess DMAc. The fibrid cake obtained was not allowed to dry out.

EXAMPLE 2

This example shows the preparation of a nonwoven sheet structure of the present invention using the fibrids of Example 1 and an aramid floc. This floc was prepared from paraphenylene terephthalamide fiber (PPD-T) Kevlar 29 fiber from E. I. du Pont de Nemours and Company, Inc.

A handsheet containing 70 wt. % of the fibrids and 30 wt. % of the floc described above was prepared from 683 mL of a 0.3% solids fibrid slurry and 1.1052 g of 0.32 cm (0.125 inch) floc. The handsheet was produced by putting the fibrids and floc and 2400 mls of water into British Pulp Evaluation Apparatus (Mavis Engineering, Ltd. No. 8233) and dispersing them for 5 minutes. This stock was added to a Noble and Woods handsheet mold and additional water added. The stock solution was agitated 10 times with an agitator plate, then vacuum drained through a screen having screen openings of 0.15 mm diameter (100 mesh screen). The sample was couched between 2 plies (each side) of blotter paper to remove excess moisture. The handsheet was then transferred to blotter paper by slapping the sample and screen onto a table top. The sample was dried on handsheet hot plate drier (Noble & Wood Model No. F10). Sample strength was judged to be sufficient to produce on a fourdrinier paper machine.

The handsheet was pressed on a hot press (Farrel Watson-Stillman, Model No. 9175-MR) at 690 kPa (100 psi), 279° C. (535° F.) for 1 minute. Sample was measured per ASTM D-828 and determined to have break strength of 0.52 N/m width (29.44 lbs/inch width) and modulus of 4227 MPa (613 kpsi).

EXAMPLE 3

This example employs the fibrids of Example 1 in making sheet structures with several different types of floc. In some instances, proportions were varied. Item G is a control using fibrids of metaphenylene isophthalamide (MPD-I). Items A and B use floc similar to that of Example 2 while Items E and F employ an aramid floc from MPD-I fiber.

The same method for producing the formed papers of Example 2 was used for making the handsheets of Items B-F, with the following compositions:

| Item | % Fibrids | % Floc | Floc Type | Length, cm (in.) |
|---|---|---|---|---|
| A | 70 | 30 | PPD-T | 0.32 (0.125) |
| B | 60 | 40 | PPD-T | 0.32 (0.125) |
| C | 60 | 40 | CARBON | 0.32 (0.125) |
| D | 70 | 30 | CARBON | 0.32 (0.125) |
| E | 60 | 40 | MPD-I | 0.64 (0.25) |
| F | 70 | 30 | MPD-I | 0.64 (0.25) |
| G | 60 | 40 | MPD-I | 0.64 (0.25) |

All papers were judged to have sufficient strength to be produced on a paper machine.

All of the handsheets from above were passed on a hot press (Farrel Watson-Stillman, Model No. 9175-MR) at 6.895 MPa (1000 psi), 279° C. (535° F.) for 1 minute. Properties are given below.

| Item | Break Strength N/m (lbs/in-width) | Normalized Brk Str N/m | Modulus MPa (kpsi) | Normalized Modulus MPa |
|---|---|---|---|---|
| A | 0.52 (29.44) | 0.39 | 4227 (61 3.53) | 3230 |
| B | 0.38 (21.97) | 0.26 | 2819 (40 8.80) | 1977 |
| C | 0.11 (6.28) | 0.19 | 562 (81.47) | 972 |
| D | 0.20 (11.37) | 0.34 | 818 (118.70) | 1385 |
| E | 0.34 (19.25) | 0.18 | 2164 (31 3.83) | 1143 |
| F | 0.29 (16.85) | 0.14 | 2282 (33 0.92) | 1118 |
| G | 0.28 (16.15) | 0.14 | 1584 (22 9.79) | 798 |

The break strength and modulus are "normalized" to the same density and basis weight as the Item G control. The carbon papers will not densify as much as less stiff fibers under the same pressing conditions. As one can see, Items A-F are superior to Item G.

EXAMPLE 4

About 22.7 kg (50 lbs) of the polymer described in Example 1 (0.5–0.6 inherent) was dissolved in enough DMAc (4% LiCl) to produce a 30% solids solution. The 30% solids solution above was passed to a fibridator of the type disclosed in U.S. Pat. No. 3,018,091. The resulting fibrids are washed with water to reduce DMAc and chloride content to about 1.0% and 0.3%, based on polymer, respectively.

11.4 kg (25.2 lbs) of the fibrids were put into a hydrapulper with 11.4 kg (25.2 lbs) of 0.64 cm (0.25 in), PPD-T floc and 3762 l (994 gallons) of water and dispersed for 15 minutes.

This stock was diluted to 0.35% solids and then pumped, through a double-disc refiner (Sprout-Waldron 12" Twin-Flo, Model no. 12-MA, Serial No. 67-1432), to a standard fourdrinier paper machine at a rate of 4.25 l/min/cm width (2.86 gallons per min./inch width) to form a sheet of 27.2 kg/914 m ream (60 lbs/3000 ft. ream) at 15.2 m (50 ft.) per min. wire speed. This sheet was dried to a moisture level of 1.15%.

Break Strength and Modulus values of this paper and a comparably made paper using MDP-I fibrids is given below for the machine direction MD and the cross direction CD.

| Item | Fibrids | Break Strength N/m (lbs/in width) MD | Break Strength N/m (lbs/in width) CD | Modulus MPa (kpsi) MD | Modulus MPa (kpsi) CD |
|---|---|---|---|---|---|
| a | above poly- | 0.04 (2.34) | 0.03 (1.55) | 95 (13.77) | 46 (6.68) |

-continued

| Item | Fibrids | Break Strength N/m (lbs/in width) MD | CD | Modulus MPa (kpsi) MD | CD |
|---|---|---|---|---|---|
| b | mer MPD-I | 0.10 (5.58) | 0.06 (3.38) | 265 (38.41) | 126 (18.30) |

The sheet samples were pressed on a hot press (Farrel Watson-Stillman, Model No. 9175-MR) at 6.895 MPa (1000 psi), 279° C. (535° F.) for 1 minute.

Break strength was measured and is shown below. Included is data for the same comparably made paper using MDP-I fibrids and PPD-T floc as a control.

| Item | MD Break Strength N/m (lbs/in width) | CD Break Strength N/m (lbs/in width) | MD Modulus MPa (Kpsi) | CD Modulus MPa (Kpsi) |
|---|---|---|---|---|
| a | 0.47 (26.98) | 0.36 (20.65) | 3286 (476.56) | 2380 (345.24) |
| b | 0.28 (16.09) | 0.20 (11.31) | 1174 (170.25) | 438 (63.51) |

It can be seen that while fibrids are employed for both Items a and b, the Item a fibrids result in substantially improved sheets. The use of glass floc in place of the aramid floc of Items a and b would be expected to give a similar improvements.

EXAMPLE 5

In this example the fibrids were prepared from a polymer consisting essentially of the following repeat units in the indicated mol ar proportions.

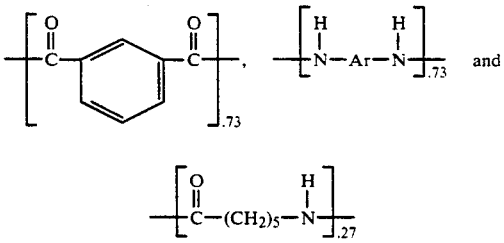

wherein Ar is a 70/30 mixture of 1,3-phenylene and 1,4-phenylene radicals, and a PPD-T floc was employed The copolymer was prepared in a 2 liter resin kettle fitted with a stirrer, heating mantle, and continuous nitrogen flow. A mixture of IBC (862.5 g, 2.4 mol), MPD (183.2 g, 1.7 mol), and PPD (78.5 g, 0.73 mol) was maintained at a temperature between 250° and 260° C. for 4 hours. The clear amber plasticized copolymer produced, in solution with residual caprolactam was allowed to cool to room temperature. The inherent viscosity of the copolymer was determined to be 0.8 and its Tg was 217° C. Its proton—NMR spectrum showed X to be 0.27.

Sixty gms of above polymer was combined with 440 gms of DMAc (4% LiCl) to yield 12% polymer solution. This solution was heated to 85° C. to dissolve the polymer until a clear, light brown/gold solution is obtained.

A Waring 7011 blender was filled with 50 mL of DMAc (4% LiCl) and 200 mL distilled water. With the blender run on high speed, 75 mL of polymer solution were poured slowly into top of blender (stream ~0.3 cm wide at top of blender). The fibrids (Fibrid A) were vacuum filtered and washed 5 times with ~500 mL of water to remove excess DMAc. The fibrid cake obtained was not allowed to dry out.

The 219 gms of this fibrid cake was mixed with 2181 mL of water to produce a 1.2% solids slurry. This slurry was dispersed for 5 minutes as described in Example 2. 750 mL of this fibrid slurry was added to 2250 mL of water to produce a 0.3% solids slurry. The 0.3% fibrid slurry was refined in a Waring Commercial Blender (CB-6, Model 33BL12) for 30 seconds on high speed.

An additional sample using MPD-I fibrids (Fibrid B) was treated to the same slurry preparation and refining steps.

A handsheet comprising 70% of Fibrid A/30% PPD-T floc was made using 683 mL of the 0.3% solids fibrid slurry and 1.1052 gms 0.125 in. PPD-T floc. The handsheet was produced by putting the fibrids and floc and an additional 2000 mls of water into British Pulp Evaluation Apparatus (Mavis Engineering, Ltd. No. 8233) and dispersing them for 5 minutes. This stock was added to a handsheet mold and additional water added. The stock solution was agitated 10 times with an agitator plate, then vacuum drained through a screen having openings of 0.15 mm diameter (100 mesh screen). The sample was couched between 2 plies (each side) of blotter paper to remove excess moisture. The handsheet was then transferred to blotter paper by slapping the sample and screen onto a table top. The sample dried on a handsheet hot plate drier. A similar sample was produced using the MPD-I fibrid slurry mentioned above as a control.

Break Strength and Modulus values of this paper and a comparably made paper using Fibrid B is given below.

| Fibrids | Break Strength N/m (lbs/in-width) | Modulus MPa (Kpsi) |
|---|---|---|
| A | 0.03 (1.75) | 72 (10.51) |
| B | 0.15 (8.50) | 219 (31.80) |

The handsheet was then pressed on a hot press at 6.895 MPa (1000 psi), 279° C. (535° F.) for 1 minute.

Break Strength and Modulus values of this paper and a comparably made paper using MPD-I fibrids is given below.

| Fibrids | Break Strength N/m (lbs/in-width) | Modulus MPa (Kpsi) |
|---|---|---|
| A | 0.58 (33.64) | 4358 (631.98) |
| B | 0.38 (22.17) | 2508 (363.78) |

EXAMPLE 6

This example is a control showing the use of thermoplastic polymer fibrids.

Thirty g of polyetherimide (PEI, ULTEM 1000 produced by G.E.) polymer were combined with 270 g of DMAc to yield 10% polymer solution. This solution was heated to 85° C. to dissolve the polymer until a clear, light brown/gold solution is obtained.

A Waring blender was filled with 50 mL of DMAc (4% LiCl) and 200 mL distilled water. With the blender run on high speed, 75 mL of polymer solution were poured slowly into the top of the blender (stream ~0.3 cm wide at top of blender). The fibrids were vacuum filtered onto Whatman International Ltd. #41 filter paper and washed 5 times with ~500 mL of water to remove excess DMAc. The fibrid cake obtained was not allowed to dry out.

A handsheet 60% PEI fibrids/30% PPD-T floc was prepared using 308 mL of a 0.3% solids fibrid slurry and 0.616 dry gms 0.64 cm (0.25 in) floc. The handsheet was produced by putting the fibrids and floc and 2400 mL of water into the British Pulp Evaluation Apparatus and dispersing them for 5 minutes. This stock was added to a handsheet mold and additional water added. The stock solution was agitated 10 times with an agitator plate, then vacuum drained through a screen having screen openings of 0.15 mm diameter (100 mesh screen). The sample was couched between 2 plies (each side) of blotter paper to remove excess moisture. The handsheet was then transferred to blotter paper to remove excess moisture. The handsheet was then transferred to blotter paper by slapping the sample and screen onto a table top. The sample dried on a handsheet hot plate drier. Sample strength was judged to be sufficient to produce on a fourdrinier paper machine.

The handsheet was then pressed on a hot press at 6.895 MPa (1000 psi), 279° C. (535° F.) for 1 minute. Sample was determined to have break strength of 0.02 (0.86 lbs/inch width) and modulus of 168 MPa (24.43 kpsi).

Similarly formed handsheets were made from Example 1 fibrids (B) and PPD-T 0.64 cm (0.25 in) floc or MPD-I fibrids (C) and PPD-T 0.64 cm (0.25 in) floc. Properties are below:

| Fibrids | Break Strength N/m (lbs/in-width) | Normalized Brk Str/ Basis Wt N/m | Modulus MPA (Kpsi) | Normalized Modulus/ Basis Wt MPa |
|---|---|---|---|---|
| PEI Fibrids | 0.02 (0.86) | 0.02 | 168 (24.43) | 155 |
| B | 0.35 (20.02) | 0.44 | 2862 (415.09) | 3623 |
| C | 0.24 (13.65) | 0.20 | 3481 (504.90) | 2950 |

The break strength and modulus of all samples are "normalized" to a basis weight of 33.9 g/sq. in (1.00 ounces per square yard). As one can see the B fibrid paper are superior to both the A and the C fibrid papers.

EXAMPLE 7

A series of copolymers was prepared from IBC and an aromatic diamine, $Ar(CH_2)_2$, or a mixture of aromatic diamines. Each copolymer was prepared in a test tube fitted with a cap lined with polytetrafluoroethylene. In each of the copolymer preparations, IBC (10.0 g, 28 mmol) and the appropriate diamine or diamines (28 mmol total, see table below) were held at 250° C. in the test tube under nitrogen for four hours. The molten mixture was swirled during the initial part of the reaction.

The aromatic diamines used to make the copolymers were the following diamines:

Metaphenylenediamine (MPD), in which Ar = 1,3-phenylene.

Paraphenylenediamine (PPD), in which Ar = 1,4-phenylene.

2,4-Diaminotoluene (DAT), in which Ar = 1-methyl-2,4-phenylene.

4,4'-Diaminodiphenylsulfone (DDS), in which Ar = 4,4'-sulfonyldiphenylene.

3,4'-Oxydiphenylamine (3,4'-ODA), in which Ar = 3,4'-oxydiphenylene.

4,4'-Oxydiphenylamine (4,4'-ODA), in which Ar = 4,4'-oxydiphenylene.

The bis(lactam) monomer used to make the copolymers were N,N'-isophthaloyl bis(caprolactam) (IBC). The copolymers evaluated were as follows:

| Item | Polymer | mmol Diamine |
|---|---|---|
| A | DAT/MPD-IBC | 8.4/19.6 |
| B | DDS-IBC | 28 |
| C | MPD-IBC | 28 |
| D | 4,4' ODA/DAT-IBC | 19.6/8.4 |
| E | DAT-IBC | 28 |
| F | 3,4' ODA/MPD-IBC | 8.4/19.6 |
| G | 4,4' ODA/DDS-IBC | 19.6/8.4 |
| H | 4,4' ODA-IBC | 28 |
| I | 4,4' ODA/PPD-IBC | 19.6/8.4 |

A 12% polymer solution was produced by dissolving each of the above copolymers in the appropriate amount of solvent, which was 100% DMAc for items A, B, E, F, I, or DMAc containing 4% LiCl for items C, D, G, H. A light brown/gold solution was obtained, and it was filtered through glass wool. This solution was heated to 85° C.

A Waring 7011 blender was filled with 50 mL of DMAc (4% LiCl) and 200 mL distilled water. With the blender run on high speed, 75 mL of polymer solution was poured slowly into the top of the blender, the stream being about 0.32 cm (⅛ in.) wide at the top of the blender. Each sample of fibrids (Fibrids A-I) was vacuum filtered and washed 5 times with about 500 mL of water to remove excess DMAc. The fibrid cake obtained was not permitted to dry out.

Each fibrid cake was mixed with the proper amount of water to produce a 1.2% solids slurry. This slurry was dispersed for 5 minutes as described in Example 2. 750 mL of this fibrid slurry was added to 2250 mL of water to produce a 0.3% solids slurry. The 0.3% fibrid slurry was "refined" in a Waring Commercial Blender (CB-6, Model 33BL12) for 30 seconds on high speed.

An additional sample using MPD-I fibrids (Item J) was treated to the same slurry preparation and refining steps.

A handsheet comprising 70% of fibrids A-I/30%PPD-T floc was made using 683 mL of the 0.3% solids fibrid slurry and 1.1052 g of 0.32 cm (0.125 in.) PPD-T floc. The handsheet was produced by putting the fibrids and floc and an additional 2000 mL of water into British Pulp Evaluation Apparatus (Mavis Engineering, Ltd. No. 8233) and dispersing them for 5 minutes. This stock was added to a handsheet mold and additional water added. The stock solution was agitated 10 times with an agitator plate, then vacuum drained through a fine screen with 0.15-mm openings. The sample was couched between 2 plies (each side) of blotter paper to remove excess moisture. The handsheet was then transferred to blotter paper by slapping the sample and 100 mesh screen onto a table top. The sample was produced using the MPD-I fibrid slurry mentioned above as a control (Item J). All handsheets were judged to have sufficient strength to be produced on a fourdrinier paper machine.

Each handsheet was then pressed on a hot press at 6895 kPa (1000 psi), 280° C. (535° F.) for 1 minute.

Breaking Strength and Modulus values of these papers and the comparably made papers using MPD-I fibrids are given below.

| Item | Breaking Strength N/m (lbs/in-width) | Normalized Brk Str (lbs/in-width) | Modulus MPa (kpsi) | Normalized Modulus MPa (kpsi) |
|---|---|---|---|---|
| A | 0.35 (19.93) | 0.82 (47.18) | 1331 (193.06) | 3151 (457.05) |
| B | 0.20 (11.62) | 0.33 (18.73) | 1815 (263.27) | 2926 (424.36) |
| C | 0.44 (25.44) | 0.67 (38.54) | 1672 (242.50) | 2532 (367.37) |
| D | 0.56 (32.37) | 0.80 (45.64) | 2288 (331.86) | 3226 (467.87) |
| E | 0.24 (14.02) | 0.34 (19.65) | 975 (141.47) | 1367 (198.30) |
| F | 0.50 (28.86) | 0.59 (34.11) | 1858 (269.51) | 2197 (318.57) |
| G | 0.44 (25.77) | 0.48 (27.32) | 2068 (299.98) | 2236 (324.30) |
| H | 0.42 (24.21) | 0.37 (21.04) | 2265 (328.50) | 1969 (285.53) |
| I | 0.70 (40.07) | 0.55 (31.40) | 2469 (358.02) | 1935 (280.58) |
| J | 0.25 (14.48) | 0.21 (12.30) | 1528 (221.61) | 1298 (188.28) |

The breaking strength and modulus are "normalized" to the same density and basis weight as the Item J control. As will be seen from these data, Items A-I are superior to Item J.

EXAMPLE 8

N,N'-isophthaloyl bis(valerolactam) and 3,4'-Oxydiphenylamine were reacted together in accordance with the procedures of copending and coassigned U.S. application Ser. No. 07/402,295 to form a copolymer having the following repeat units:

$[O{=}C-m-phenylene-C{=}O]_{0.91}$ $[HN-3,4'-oxydiphenylene-NH]_{0.91}$ and $[O{=}C-(CH_2)_4-NH]_{0.09}$ About 50 lbs. of this polymer (having an inherent viscosity of 0.5–0.6) was dissolved in enough DMAc (4% LiCl) to produce a 30% solids solution. The 30% solids solution was passed to a fibrilator of the type disclosed in U.S. Pat, No. 3,018,091. The resulting fibrids are washed with water to reduce DMAc and chloride content to about 1.0% and 0.3%, based on polymer, respectively. The fibrid cake obtained was not allowed to dry out.

The fibrid cake was mixed with the proper amount of water to produce a 1.2% solids slurry. This slurry was dispersed for 5 minutes as described in Example 2 above. 750 mL of this fibrid slurry was added. The 0.3% fibrid slurry was refined in a Waring Commercial Blender (CB-6, Model 33BL12) for 30 seconds at high speed.

An additional sample using MPD-I fibrids (see Ex. 7, Item J) was treated to the same slurry preparation and refining steps.

A handsheet comprising 70% of Fibrids A-I/30% PPD-T floc was made using 683 mL of the 0.3% solids fibrid slurry and 1.1052 gms 0.125 in. PPD-T floc. The handsheet was produced by putting the fibrids and floc and an additional 2000 mls of water into British Pulp Evaluation Apparatus (Mavis Engineering, Ltd. No. 8223) and dispersing them for 5 minutes. This stock was added to a handsheet mold, and additional water was added. The stock solution was agitated 10 times with an agitator plate, then vacuum drained through a 100 mesh screen. The sample was couched between 2 plies (each side) of blotter paper to remove excess moisture. The handsheet was then transferred to blotter paper by slapping the sample and 100 mesh screen onto a table top. The sample dried on a handsheet hot plate drier. A similar sample was produced using the MPD-I fibrid slurry mentioned above as a control (Example 7, Item J). All handsheets were judged to have sufficient strength to be produced on a fourdrinier paper machine.

Each handsheet was then pressed on a hot press at 6895 kPa (1000 psi), 280° C. (535° F.) for 1 minute.

Breaking Strength and Modulus values of these papers and the comparably made papers using MPD-I fibrids are given below.

| | Breaking Strength N/m (lbs/in-width) | Normalized Brk Str N/m (lbs/in-width) | Modulus MPa (kpsi) | Normalized Modulus MPa (kpsi) |
|---|---|---|---|---|
| A | 0.41 (23.62) | 0.87 (49.73) | 1201 (174.27) | 2530 (366.88) |
| B | 0.25 (14.48) | 0.21 (12.30) | 1528 (221.61) | 1298 (188.28) |

The breaking strength and modulus are "normalized" to the same density and basis weight as the Item J control. As will be seen from these data, Item A is superior to Item J.

We claim:

1. Fibrids consisting essentially of the following units:

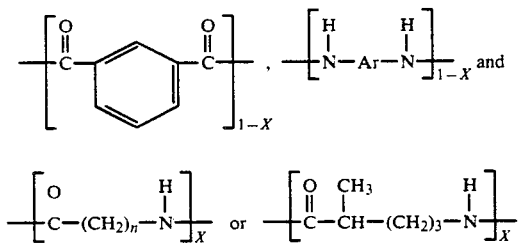

where n is 4 or 5; X is from 0.03 to 0.30 and Ar is a radical selected from 3,4'-oxydiphenylene, 4,4'-oxydiphenylene, 4,4'-sulfonyldiphenylene, 3-phenylene and mixtures of such radicals with each other or mixtures of such radicals with up to 50 mol percent of 1,4-phenylene radicals based on the mixture of radials.

2. A high strength sheet structure consisting essentially of from 10 to 90 wt. % of floc of carbon, aramid or glass fiber held in place with from 90 to 10 wt. % of fused fibrids consisting essentially of the following units:

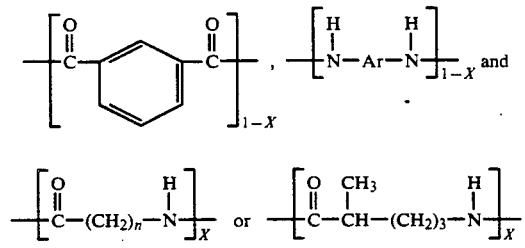

where n is 4 or 5; X is from 0.03 to 0.30 and Ar is a radical selected from 3,4'-oxydiphenylene, 4,4'-oxydiphenylene, 4,4'-sulfonyldiphenylene, 1,3 phenylene, 1-methyl-2,4-phenylene, and mixtures of such radicals with each other or mixtures of such radicals with up to 50 mol percent of 1,4-phenylene radicals based on the mixture of radicals.

3. A sheet structure according to claim 2 wherein carbon floc is employed.

4. A sheet structure according to claim 2 wherein aramid floc is employed.

5. A sheet structure according to claim 2 wherein glass floc is employed.

6. A sheet structure according to claim 2 wherein the fibrids consist essentially of the following units:

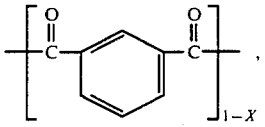

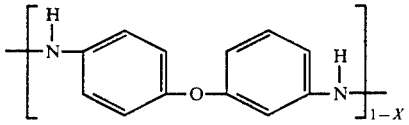

and

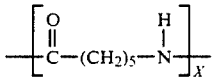

wherein X is from 0.03 to 0.30.

7. A sheet structure according to claim 2 wherein the fibrids consist essentially of the following units:

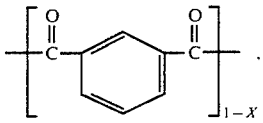

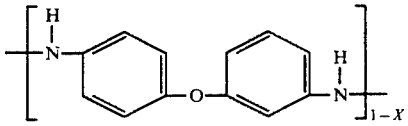

and

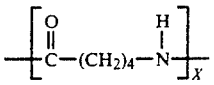

wherein X is from 0.03 to 0.30.

8. A sheet structure according to claim 2 where the fibrids consist essentially of the following units:

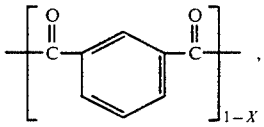

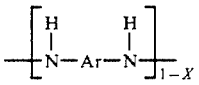

and

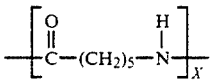

wherein Ar is a 70/30 mixture of 1,3-phenylene and 1,4-phenylene radicals and X is from 0.03 to 0.30.

* * * * *